United States Patent [19]

Brooks et al.

[11] Patent Number: 4,623,575

[45] Date of Patent: Nov. 18, 1986

[54] LIGHTLY ENTANGLED AND DRY PRINTED NONWOVEN FABRICS AND METHODS FOR PRODUCING THE SAME

[75] Inventors: Berry A. Brooks, Longmeadow, Mass.; John W. Kennette, Somerville; Conrad C. Buyofsky, South River, both of N.J.

[73] Assignee: Chicopee, New Brunswick, N.J.

[21] Appl. No.: 698,929

[22] Filed: Feb. 7, 1985

Related U.S. Application Data

[63] Continuation-in-part of Ser. No. 293,740, Aug. 17, 1981, abandoned, and a continuation of Ser. No. 677,884, Dec. 3, 1984, abandoned, which is a continuation of Ser. No. 540,113, Oct. 11, 1983, abandoned, which is a continuation of Ser. No. 282,481, Jul. 13, 1981, abandoned, which is a continuation of Ser. No. 115,117, Jan. 25, 1980, abandoned, which is a continuation-in-part of Ser. No. 12,417, Feb. 15, 1979, abandoned.

[51] Int. Cl.[4] ..... B32B 5/12

[52] U.S. Cl. ..... 428/113; 156/62.4; 156/209; 156/296; 156/305; 156/314; 264/119; 264/128; 264/570; 428/131; 428/189; 428/198; 428/288

[58] Field of Search ..... 428/113, 131, 198, 288, 428/134, 227, 340; 264/546, 557, 570, 119, 128; 156/62.4, 209, 296, 305, 314; 427/208, 275, 277, 288

[56] References Cited

U.S. PATENT DOCUMENTS

| | | | |
|---|---|---|---|
| 3,009,822 | 11/1961 | Drelich | 428/198 |
| 3,120,449 | 2/1964 | Griswold | 117/38 |
| 3,485,706 | 12/1969 | Evans | 428/198 |
| 3,965,519 | 6/1976 | Hermann | 15/104.93 |
| 4,057,669 | 11/1977 | McConnell | 428/152 |

FOREIGN PATENT DOCUMENTS 2045825 11/1980 United Kingdom .

*Primary Examiner*—Marion C. McCamish
*Attorney, Agent, or Firm*—Nancy A. Bird

[57] ABSTRACT

A strong, durable nonwoven fabric comprising polyester and/or polyolefin fibers arranged in a pattern of high density, lightly entangled fiber regions. Distributed throughout the fibers is an adhesive binder material to provide the final fabric with improved strength characteristics.

Entangled nonwoven fabrics are dry print bonded to produce nonwoven fabrics having an excellent combination of strength, softness and durability.

21 Claims, 9 Drawing Figures

LIGHTLY ENTANGLED AND DRY PRINTED NONWOVEN FABRICS AND METHODS FOR PRODUCING THE SAME

CROSS-REFERENCE TO RELATED APPLICATIONS

This application is a joint application filed pursuant to 35 U.S.C. §116, as amended Nov. 8, 1984, and is (1) a continuation U.S. application Ser. No. 677,884, filed Dec. 3, 1984 by Berry A. Brooks, now abandoned, which is a continuation of application Ser. No. 540,113, filed Oct. 11, 1983, now abandoned, which is a continuation of application Ser. No. 282,481, filed July 13, 1981, now abandoned, which is a continuation of application Ser. No. 115,117, filed Jan. 25, 1980, now abandoned which is a continuation-in-part of application Ser. No. 12,417, filed Feb. 15, 1979, now abandoned; and is (2) a continuation-in-part of U.S. application Ser. No. 293,740, filed Aug. 17, 1981, by John W. Kennette and Conrad C. Buyofsky now abandoned.

This invention relates to new and improved nonwoven fabrics and methods for manufacturing the same.

BACKGROUND OF THE INVENTION

A. Prior Art

Nonwoven fabrics have been known for some time. Nonwoven fabrics have been made from synthetic fibers such as the polyester and polypropylene fibers. Generally, these fabrics are produced by forming a web of fibers and applying an adhesive binder to the web to hold the fibers together and provide strength. In some instances (i.e., the spunbonding technique), synthetic polymers are extruded into filaments and directly formed into webs which selfbond to produce the final fabric. In other instances, the fibrous web is fluid rearranged and then resin binder is added to form a useful, coherent nonwoven fabric. See, for instance, Kalwaites, U.S. Pat. Nos. 2,862,251, 3,033,721, 3,193,436, and 3,769,659, and Griswold, U.S. Pat. Nos. 3,081,515 and 3,025,585. Still other nonwoven fabrics are made by forming a web of synthetic fibers and treating it with high-pressure jets to entangle the fibers and produce a strong fabric that does not require the addition of binder to be self-supporting and useful for many purposes. Such a technique is described by Evans in U.S. Pat. No. 3,485,706 and Canadian Pat. No. 791,925.

The prior art polyester fiber nonwoven fabrics suffer from one or more of the following problems: Adhesively bonded webs of textile polyester fibers require relatively large amounts of adhesive binder for most end uses to provide the fabric with adequate strength. The large amount of binder increases cost and can detract from the desirable textile-like properties of the fiber itself. The spunbonded type of product is expensive, and being of continuous extruded filaments, also has some limitations on its functional properties and its textile-like nature. For instance, spunbonded fabrics can be stiff and boardy in the higher weight range of products. The highly entangled fabrics of Evans have excellent fabric properties, but the Evans process requires a substantial capital investment and it uses large amounts of power. This invention provides a process and fabric product that eliminate many of the above-mentioned problems.

B. Objects Of The Invention

It is an object of the invention to provide a relatively economical process for producing strong, durable nonwoven fabrics having reduced binder content.

It is another object of the invention to provide a process for producing strong, durable nonwoven fabrics from polyester and/or polyolefin fibers.

It is a further object of the invention to provide strong, durable polyester and/or polyolefin nonwoven fabrics.

Still another object of the invention is to provide an economical process for producing strong, durable polyester and/or polyolefin nonwoven fabrics having reduced binder content.

These and other objects of the invention will be apparent from the following description of the invention.

SUMMARY OF THE INVENTION

The invention provides a strong, durable nonwoven fabric comprising a layer of polyester and/or polyolefin fibers disposed in a regular repeating pattern of lightly entangled fiber regions of higher area density than the average area density of the layer, and interconnecting fibers extending between said regions and being randomly lightly entangled with each other in said regions, and an adhesive binder material distributed in said layer. These fabrics are produced by a process which includes the steps of lightly entangling a layer of polyester and/or polyolefin fibers, followed by applying adhesive bonding material to the lightly entangled layer.

DESCRIPTION OF THE INVENTION

The nonwoven fabric of the invention comprises a layer of polyester and/or polyolefin fibers, with the fibers being disposed in a regular repeating pattern of lightly entangled fiber regions of higher area density than the average area density of the layer. The fiber layer has interconnecting fibers which extend between the said lightly entangled fiber regions. The interconnecting fibers are randomly entangled with each other in the regions. The fabric also contains an effective amount, for instance, from about $2\frac{1}{2}$ percent to about 30 percent by weight of the fabric, plus binder, of an adhesive binder material. The adhesive binder material can be distributed in the fabric in a spaced, intermittent pattern of binder sites, or it can be uniformly distributed throughout the fabric.

The nonwoven fabric of the invention is made by forming a layer of overlapping, intersecting polyester and/or polyolefin fibers. The fibrous layer is supported on an apertured patterned member having apertures arranged in a pattern. Liquid streams are jetted at the layer to randomly and lightly entangle the layer in a pattern of high-density regions interconnected by fibers extending between regions. An adhesive binder material is then applied to the layer of lightly entangled fibers.

The fibrous web can be formed in any convenient known manner, as by air-laying or carding. The web is then lightly entangled by passing the fibrious web under essentially columnar liquid streams while the web is supported on a foraminous forming or patterning member. Apparatus such as the general type disclosed by Evans in U.S. Pat. No. 3,485,706 can be employed to carry out the entangling. It is an important feature of the invention that the fiber layer is lightly entangled. For instance, it is preferred that the lightly entangled fibrous layer have a structural measure of fiber entanglement of less than 0.1. (The test procedure for measuring the structural measure of fiber entanglement is set forth below.)

A typical apparatus for carrying out the process of the invention employs rows of orifices through which liquid (usually water) is jetted under pressure in the form of essentially columnar jets. A suitable apparatus has up to 20–25 rows of orifices, with the orifices being spaced such that there are about 30 to 50 orifices per linear inch. The orifices are preferably circular, with diameters of from 0.005 to 0.007 inch. The traveling fibrous web can be positioned about 1 to 2 inches below the orifices.

Using the above-described typical apparatus, representative conditions include a liquid pressure of about 200 to 700 psi and a web speed of up to 100 yards per minute, for a fibrous web weighing about ½ to 2½ ounces per square yard. Routine experimentation that is well within the ordinary skill in the art will suffice to determine the desired conditions for particular cases.

After the fibrous web has been lightly entangled, it is bonded employing known procedures. For instance, the lightly entangled web may be passed through a print-bonding station which employs a set of counterrotating rolls. The upper (back-up) roll is adjustable, and the lower (applicator) roll is engraved with a predetermined pattern to be printed. The lower roll is partially immersed in a bath of binder solution or suspension. As the roll rotates, it picks up binder, and a doctor blade wipes the roll clean except for the binder contained in the engraved pattern. As the web passes through the nip between the rolls, the binder is printed on the web from the engraved pattern. This procedure is well known in the art. U.S. patents which disclose such print bonding of nonwoven fibrous webs include U.S. Pat. Nos. 2,705,498, 2,705,687, 2,705,688, 2,880,111, and 3,009,822. If desired the web may also be overall saturation bonded.

The adhesive binder employed can be any of the aqueous latex binders that are conventionally employed as binders for nonwoven fabrics. Such binders include acrylics, ethylene-vinyl acetate copolymers, SBR latex rubbers, and the like.

After the binder has been applied, the printed web is dried in the usual fashion, as by passing the web over a series of drying cans.

The binder is employed in an effective amount, that is, that amount which will result in a fabric having sufficient strength and cohesiveness for the intended end-use application. The exact amount of binder employed depends, in apart, upon factors such as nature of fiber, weight of fibrous layer, nature of binder, and the like. Usually, an effective amount will be found within the range of from about 5 to about 30 weight percent, based upon weight of fibers plus binder.

The fibers used to produce the products of the invention are polyester or polyolefin, such as polypropylene or high density polyethylene, fibers. The fibers may have a denier of from 1 or less up to 15 or more and they may be in the form of short fibers such as ¼ inch in length up to as long as continuous filament fibers. Preferably, fibers in the range of ¾ to 2 inches in length are used. The weight of the fiber layer used to produce the fabrics of the present invention may vary from 100 grains per square yard to a few thousand grains per square yard.

The invention will be further illustrated in greater detail by the following specific examples.

EXAMPLE 1

A web of 1.75 denier 1.5 inch polyester fibers weighing 537 grains per square yard is formed using an air-laying machine sold by the Rando Machine Corporation of Rochester, N.Y. under the trade name Rando Webber. The web is placed on a woven belt. The belt is woven with 22 warp filaments per inch and 24 filling filaments. The belt has 528 openings per square inch. The web and belt are passed under 16 manifolds. Each manifold contains 2 rows of 12 orifices per inch running in the transverse direction of the web. Each orifice is rectangular, with an opening of about 0.012 inch by 0.014 inch. Water is jetted through the orifices onto the web at a pressure of about 250 pounds per square inch to lightly entangle the fibers into a pattern of high density regions. The lightly entangled web is passed through a pair of print rolls. The top roll is a flannel-covered, rubber back-up roll, and the bottom rcle is an engraved roll. The engraved roll is engraved with 6 wavy lines per inch running parallel to the axis of the roll. (See, FIG. 1 of U.S. Pat. No. 3,009,822). Each line has a width of about 0.024 inch. The roll rotates in a pan of binder material and picks up the binder material and places it on the web. The binder material has the following composition: a self-cross-linking vinyl acrylic terpolymer sold by the National Starch Company as NS2853; water; and water soluble hydrophylic surfactant sold by Atlas Chemicals as Tween 20. Approximately 125 grains per square yard of binder is applied. The fabric is dried at a temperature of 270° F. for 1 minute to remove excess water and cure the binder. The fabric contains lightly entangled fiber areas of higher density. The higher density areas are interconnected by fibers extending between the areas. The binder material runs transverse of the fabric and bonds the fibers together. The strength of the resultant fabric is tested using an Instron Tensile tester in accordance with ASTM Method No. D-1117. The fabric has a strip tenacity in the machine direction of 1.19 pounds per inch per 100 grains and a strip tenacity in the cross direction of 0.89 pound per inch per 100 grains.

CONTROL EXAMPLE 1

For comparison purposes, a part of the air-layered polyester fiber wet, used in Example 1 is not lightly entangled, but binder is applied to the air-layered web and then cured using conditions analogous to those described in Example 1. Also, another portion of the air-layered polyester fiber web is lightly entangled as described in Example 1, and is then dried to remove water. No adhesive binder is applied. Both of these comparative samples are tested for tenacity by the same method described in Example 1. The fabric which is only adhesively bonded and not lightly entangled has a strip tenancity in the machine direction of 0.505 pound per inch per 100 grains, and a strip tenacity in the cross direction of 0.209 pound per inch per 100 grains. The fabric which was lightly entangled but not adhesively bonded had a strip tenacity in the machine direction of 0.476 pound per inch per 100 grains, and a strip tenacity in the cross direction of 0.358 pound per inch per 100 grains.

EXAMPLE 2

By procedures analogous to those described above in Example 1 and Control Example 1, polypropylene fibers were formed into a web using the "Rando Webber" air-laying machine, and were then subjected to light entanglement plus print bonding with NS2853 (Run 1), light entanglement only (Run 2), and print bonding only with NS2853 (Run 3). The resulting nonwoven fabrics were tested for grab tensile strength (ASTM D-1117) and specific grab tensile (ASTM D-1117) in the machine and cross directions. The results are displayed in Table I:

TABLE I

| Run No. | Weight, Grains/yd$^2$ | Grab Tensile, pounds/inch M/D | Grab Tensile, pounds/inch C/D | Specific Grab Tensile, lbs/in/gr/yd$^2$ M/D | Specific Grab Tensile, lbs/in/gr/yd$^2$ C/D |
|---|---|---|---|---|---|
| 1 | 597 | 11.1 | 8.7 | 1.86 | 1.46 |
| 2 | 432 | 0.6 | 0.5 | 0.15 | 0.12 |
| 3 | 588 | 2.6 | 1.6 | 0.44 | 0.27 |

CONTROL EXAMPLE 2

By a procedure analogous to that described in Example 1 and Control Example 1, rayon fibers were formed into a web using the "Rando Webber" air-laying machine, and then subjecting to light entanglement plus print bonding with NS2853 (Run 1), light entanglement only (Run 2), and print bonding only (Run 3). The resulting nonwoven fabrics were tested for strip tenacity (ASTM D-1117) in the machine and cross direction. The results are displayed in Table II:

TABLE II

| Run No. | Weight, Grains/yd$^2$ | Strip Tenacity lbs/in/100 grains/yd$^2$ M/D | Strip Tenacity lbs/in/100 grains/yd$^2$ C/D |
|---|---|---|---|
| 1 | 697 | 1.94 | 0.53 |
| 2 | 514 | 0.84 | 0.51 |
| 3 | 676 | 1.03 | 0.67 |

Unlike the case with polyester and polypropylene fibers, when rayon fibers are lightly entangled plus print bonded, the strengths are not greater than the sum of the strengths obtained by entangling and printing alone. In fact, printing without entangling actually gave higher strengths than printing plus light entangling.

EXAMPLE 3

A web of $1\frac{1}{2}$ denier $1\frac{3}{4}$ inch polyester fibers weighing about 375 grains per square yard is formed by a "Rando Webber." The web is placed on a 16×14 woven belt. The web and belt are passed under four strips, each containing 50 orifices per inch running in the cross direction. Each orifice is circular with a diameter of 0.005 inch. Water at a temperature of 140° F. is jetted through the orifices at a pressure of 500 psi to lightly entangle the fibers into a pattern of high density regions. The speed of the belt and web under the orifices is 45 feet per minute. The lightly entangled web is dried by passing it over a series of steam cans.

Portions of the lightly entangled web are saturation bonded by padding with varying proportions of a self-cross-linking vinyl acrylic terpolymer latex sold by National Starch Company as NS2853. The samples with binder are dried at 300° F. The unbonded and bonded webs are tested for specific grab tenacity and strip tenacity. The results are set forth below in Table III.

CONTROL EXAMPLE 3

Using the same polyester fiber described in Example 3, a "Rosebud" web is produced Rando Webber-laid web using the process of Kalwaites, U.S. Pat. Nos. 2,862,251, and 3,033,721. The water pressure employed is 200 psi. The web product weighs about 400 grains per square yard. The web is dried, and then portions of it are saturation bonded with varying proportions of the binder described in Example 3, and then dried at 300° F. The unbonded and bonded webs are tested for specific grab tenacity and strip tenacity. The results are displayed in Table III.

TABLE III

| Binder Content, Percent | Example 3 M/D | Example 3 C/D | Control Example 3 M/D | Control Example 3 C/D |
|---|---|---|---|---|
| | Specific Grab Tenacity lbs/in/gr/yd$^2$ | | | |
| 0 | 1.62 | 1.11 | 0.12 | 0.11 |
| $2\frac{1}{2}$ | 2.73 | 2.36 | 1.96 | 1.26 |
| 5 | 3.23 | 2.55 | 2.05 | 1.75 |
| 10 | 3.61 | 3.06 | 2.97 | 2.99 |
| 20 | 3.01 | 2.41 | 3.48 | 3.30 |
| 40 | 3.37 | 2.31 | 2.91 | 2.84 |
| | Specific Tenacity, lbs/in/100 grains/yd$^2$ | | | |
| 0 | 0.38 | 0.17 | 0.03 | 0.02 |
| $2\frac{1}{2}$ | 1.03 | 0.55 | 0.33 | 0.22 |
| 5 | 1.13 | 0.78 | 0.57 | 0.51 |
| 10 | 1.57 | 0.96 | 1.10 | 1.00 |
| 20 | 2.31 | 0.91 | 1.48 | 1.56 |
| 40 | 2.00 | 0.84 | 1.54 | 1.51 |

On visual examination of the above-described samples, the sample of Example 3 containing $2\frac{1}{2}$ percent binder is strong enough to be handled, and could be used as an interlining in clothing manufacture. The Control Example 3 containing $2\frac{1}{2}$ percent binder is just barely strong enough to be handled, has poor abrasion resistance and surface fiber tie-down, and appears to lack sufficient integrity to have any significant commercial use. It is probably that the Control Example lacks sufficient integrity to have significant commercial use until the 10 percent binder level is attained; but at 10 percent binder, stiffness imparted by the binder begins to be a factor which limits potential commercial uses.

Structural Measure of Fiber Entanglement

The unbonded samples of Example 3 and Control Example 3 are evaluated for "S," the Structural Measure of Fiber Entanglement. The results are as follows:

Example 3—0.0564

Control Example 3—0.0190

The procedure for determining this value is the following:

Structurally, the extent of fiber interentanglement is related to the concentration of fibers in the interentangled area (C) and the density of the interentangled mass (d). The product of these two factors provides a measure of the frictional engagement and interaction of the fibers in the interentangled areas serving tc lock the fibers in place in the fabric to thereby permit maximum utilization of fiber strength when the fabric is subjected to stress. Also influencing maximum utilization of fiber strength is the cooperation-under-stress exhibited by the group of fibers which extends between any two entangled areas, which cooperation is inversely related to the average-free-length-factor of the individual fibers in the group (F). The structural measure of entanglement and cooperation (S) is defined by the following equation:

$$S=C/F$$

S is, in turn, related to the percent of fiber strength converted to fabric strength. The relationship is approximated by the following empirical equation:

$$S=0.0593+0.00362\ (\%\ \text{conversion})+0.000543\ (\%\ \text{conversion})^2$$

The fiber concentration factor (C) is the ratio of the length of fiber actually in the entangled area to the length which would be there if there were no patterning and/or entanglement of the fibers, i.e., if the fibers of the fabric were uniformly distributed in the plane of the fabric. Since there is a direct relation between fiber length and fiber weight, the fiber concentration factor (C) may also be described as the ratio of the weight per unit area of the entangled portion ($W_1$) to the weight per unit area of the entire fabric ($W_1$), i.e.:

$$C=W_1/W_2$$

$W_1$ and $W_2$ are determined from the fabric sample by direct measurement. For $W_1$, an average of ten values is used and each value is determined by cutting the entangled mass or representative portion thereof from the fabric with a suitable die. The area of the mass then corresponds to the area of the die. All ten specimens are weighed at one time on a suitable microbalance.

The density (d) of the entangled mass can be measured by calculating the volumes of the cut-out specimens mentioned above. To do this, the specimens are mounted axially on broaches and are photographed at 20× to provide a cross-sectional view. The cross-section thus photographed may be irregular in shape. If so, the shape is approximated with rectangles and/or triangles. The shapes are then measured and, using the appropriate geometric formulas, the corresponding volumes are calculated. The total weight of the ten specimens is then divided by the sum of the ten volumes to give the average density (d) in grams/cu. centimeter of the entangled area. The average-free-length-factor (F) of the fibers in the group extending between any two entangled areas is estimated by direct observation (under a microscope) of the fibers in the group and comparison to a set of standards.

In practice, it is observed that structures made from straight (i.e., non-crimped or -curled) fibers do not have ratings of one (corresponding to no curvature). Instead, there is always some free length and an appropriate class rating which may be used for structures made from straight fibers is F=1.4. Similarly, it is observed that the rating for samples made from conventional staple fibers or low crimp continuous filaments ranges from 1.8 to 2.5. For such fibers, an average class rating of F=2.1 may be used. For highly crimped fibers, the actual measured values of F should be used. The formula for S recognizes that the free-length-factor is inversely related to strength conversion, i.e., the greater the free-length-factor, the more chance for poor fiber cooperation and the greater the reduction in weight per unit area of the sample when stressed until a break occurs.

Dry Print Bonded Nonwoven Fabric

The invention relates to a process for dry print bonding nonwoven fabrics to produce a novel nonwoven fabric product having an excellent combination of strength, softness, and durability.

BACKGROUND OF THE INVENTION

The print bonding of nonwoven fabrics is a mature commercial technology. In a typical commercial operation, a carded or random laid web of staple-length fibers is first wetted, is optionally subjected to fluid rearrangement, and is then print bonded with an aqueous resin binder composition, and is then subjected to elevated temperature to dry the fibrous web and cure the binder. Early disclosures of such print bonding of nonwoven fabrics include U.S. Pat. Nos. 2,039,312, Joshua Goldman, 2,545,952, Ester Goldman, 3,009,822 and 3,009,823, and Drelich et al., 2,705,688Ness el at. While the point is not addressed in most of these early patents, in commercial practice the fibrous web composed of a random array of staple-length fibers is wet when it is print bonded because such a web, when dry, lacks sufficient cohesive strength to resist fiber pick off onto the print roll. (In the cited Esther Goldman patent, it is mentioned that it is preferable to wet out the web before applying binder in order to achieve better penetration of the binder.)

One result of printing binder onto a wet fibrous web is that the binder tends to diffuse or migrate before it cures or hardens. Because of this, a certain degree of softness, drape, and hand is lost, and harshness, stiffness, and boardiness are slightly increased.

One way of controlling the migration of binder is to employ binder compositions that rapidly coagulate or precipitate when deposited onto the wet web. Various ways of accomplishing this have been disclosed by Arthur Drelich and coworkers, e.g., in U.S. Pat. Nos. 4,084,033, 3,865,775, 3,720,562, 3,535,142, 3,536,518, and Re. 28,957. These techniques are especially useful in minimizing lateral spread of binder. Migration control techniques are preferably employed so as to have the binder penetrate all the way through the web. In this respect, see Example XIII and Col. 21, lines 45 et seq. of U.S. Pat. No. 3,720,562 and Example XX and Col. 11, lines 61 et seq. of U.S. Pat. No. 3,865,775, which show the prior art position that rotogravure print bonding onto dry webs composed of a random array of unentangled staple-length fibers cannot be used to produce a fabric having sufficient strength or integrity to be used commercially by itself (i.e., without being laminated to another article).

Until the recent past, print bonding of nonwoven fabrics has been carried out commercially mostly on carded or random laid webs, either as formed or after fluid rearrangement of the type contemplated by, for example, Kalwaites in U.S. Pat. Nos. 2,862,251 and 3,033,721. More recently, print bonding and/or saturation bonding has been carried out on lightly entangled nonwoven webs using fine, high pressure, columnar jets of water to lightly entangle the fibers. Such webs are first lightly entangled and are then print bonded and/or saturation bonded in one continuous operation. They are wet when the binder is applied.

Russel et al., in U.S. Pat. No. 3,908,058, and Roberts, in U.S. Pat. No. 3,903,342, have disclosed the use of print bonding patterns substantially limited to the surface, to increase the abrasion resistance of fibrous webs composed at least predominantly of wood pulp fibers.

At col. 14, lines 38 et seq. of Evans, U.S. Pat. No. 3,485,706, it is disclosed that water jet entangled nonwoven fabrics may be treated with binders. It is not specified whether such "treatment" is carried out on wet or dry webs, or what type of binder pattern is used, or how the binder is applied.

BRIEF SUMMARY OF THE INVENTION

The invention provides a process wherein fibrous webs composed of staple fibers are first entangled, then dried, and then print bonded to produce novel nonwoven fabrics having an excellent combination of softness, strength, and durability.

DETAILED DESCRIPTION OF THE INVENTION

Figure 1:
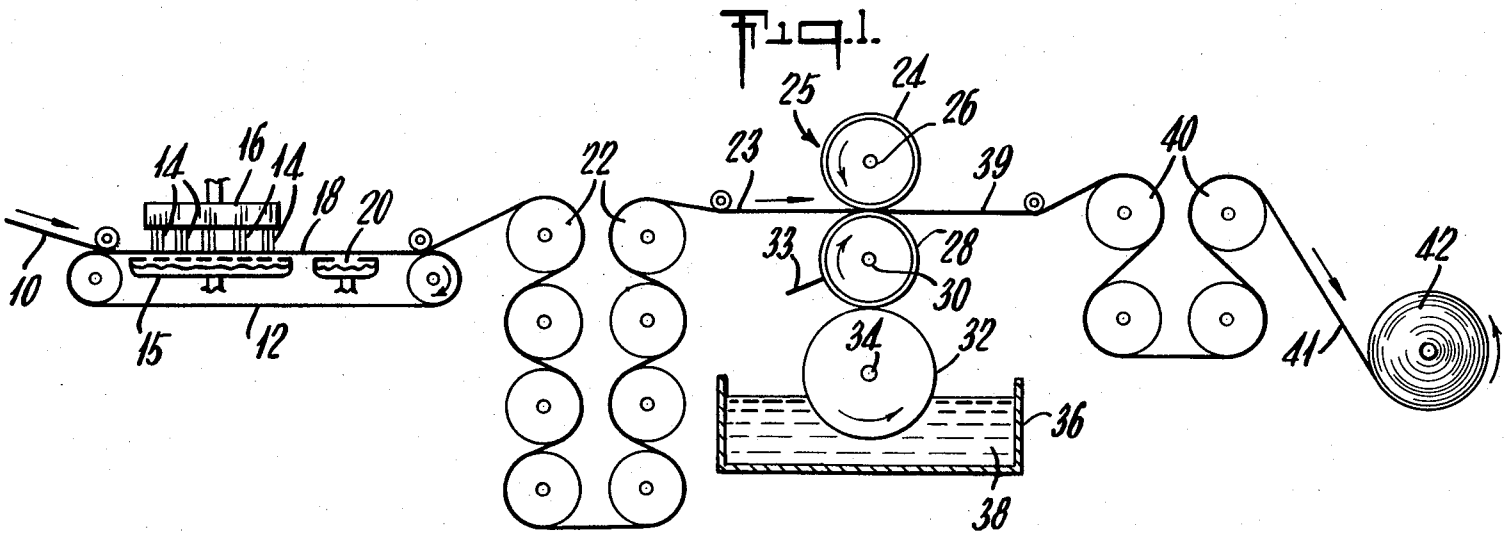
FIG. 1 is a schematic side elevation of one form of apparatus suitable for carrying out the process of the invention.
Figure 2:
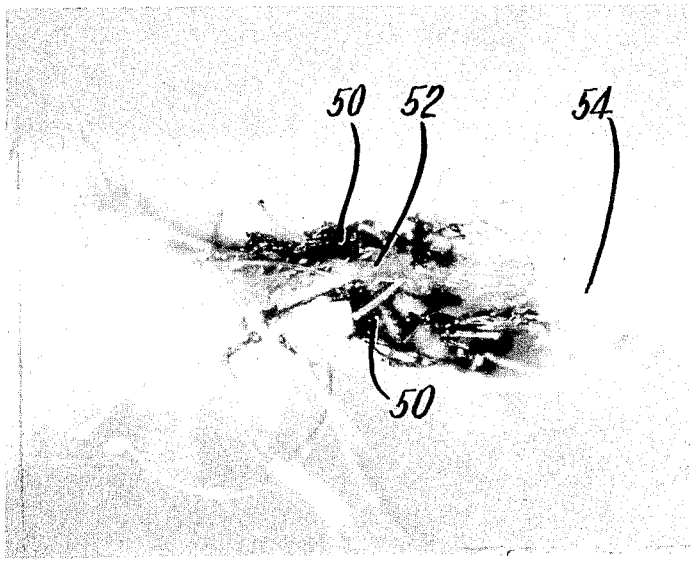
FIGS. 2–5 are photomacrographs, originally taken at 50×, of cross-sections of nonwoven fabrics made in accordance with the invention, as described in Examples 1–4, respectively.
Figure 3:
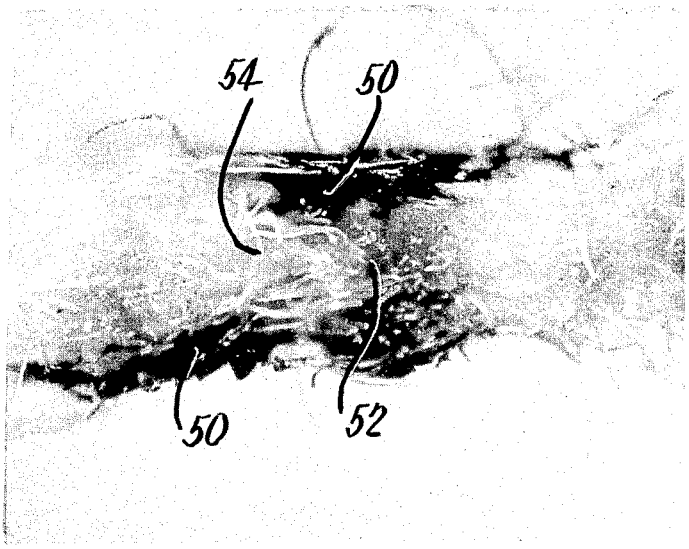
Figure 4:
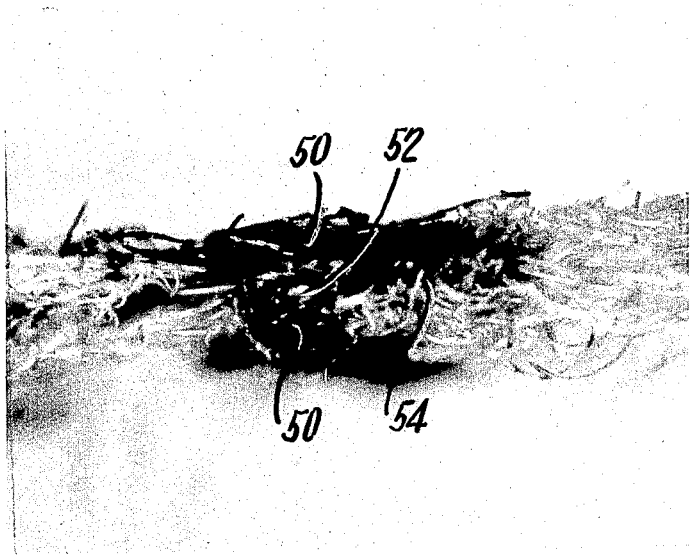
Figure 5:
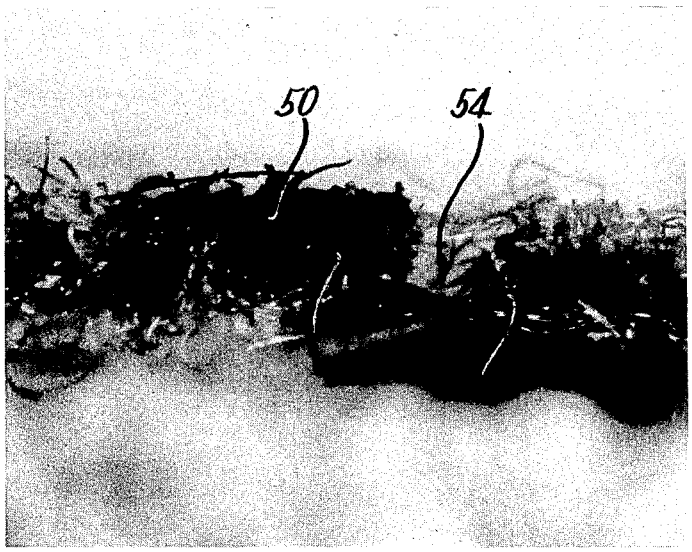
Figure 6:
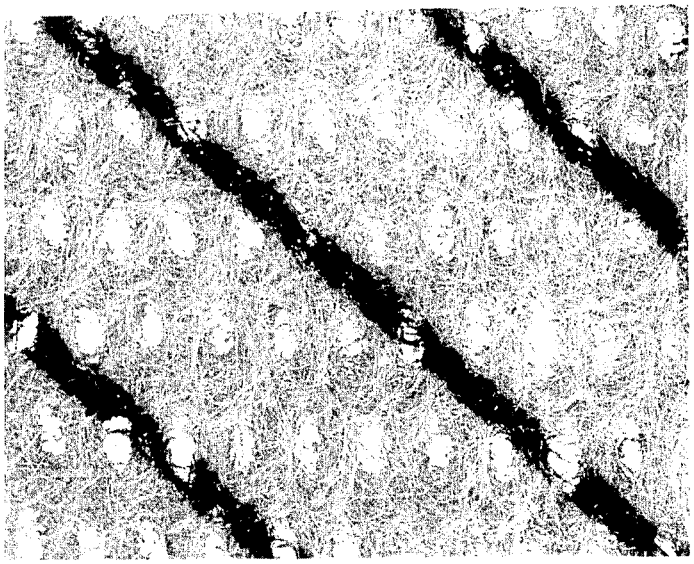
FIGS. 6–9 are photomacrographs, originally taken at 10×, of the nonwoven fabrics described in Examples 1–4, respectively.
Figure 7:
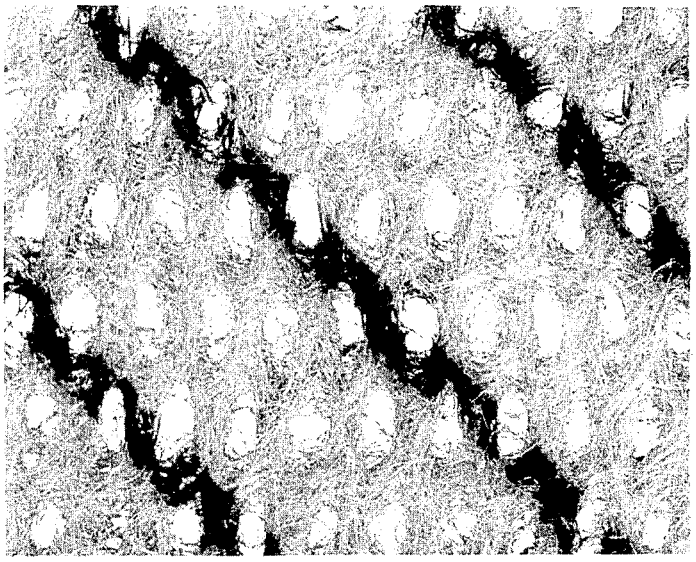
Figure 8:
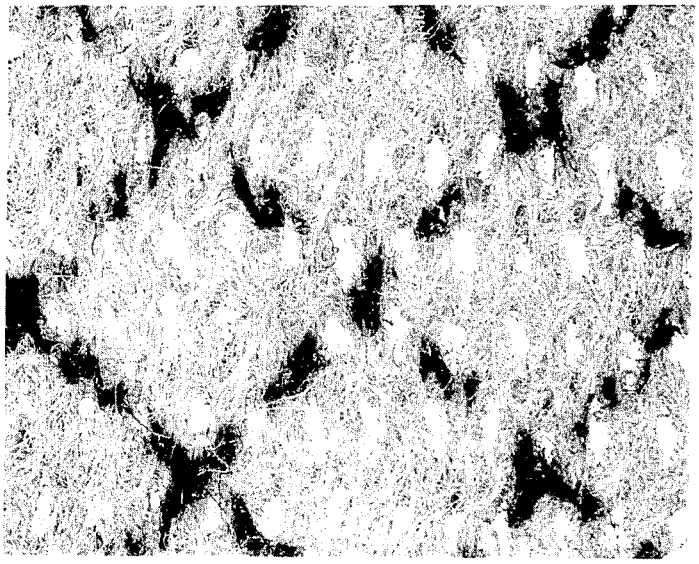
Figure 9:
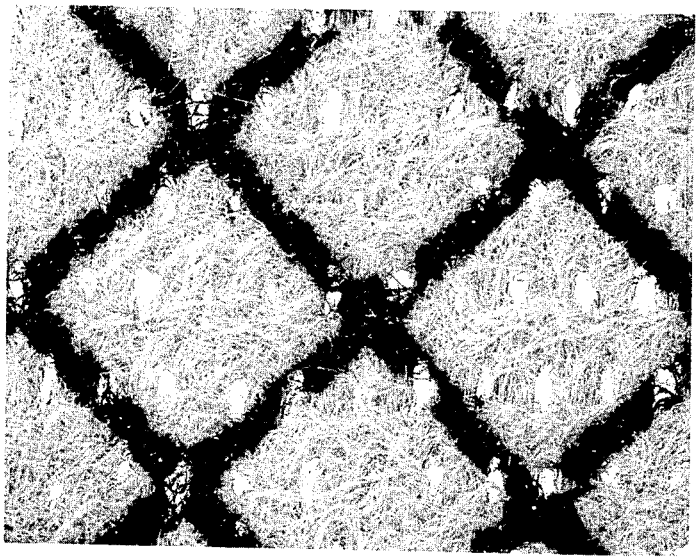

Referring first to FIG. 1, a carded or random laid web 10 of staple fibers is passed onto a liquid pervious support member, such as an endless woven belt 12. The belt 12 carries the web of fibers 10 under a series of high pressure, fine, essentially columnar jets of water 14. The high pressure water is supplied from a manifold 16. The jets 14 are arranged in rows disposed transversely across the path of travel of the belt 12. Preferably, there is a vacuum means 15 pulling a vacuum of e.g., up to 5 to 10 inches of mercury, beneath the belt 12, with a vacuum slot positioned directly under each row of jets 14. The fibers in the web 10 are rearranged and entangled by the jets 14 as the liquid from the jets 14 passes through the fibrous web 10 and then through the belt 12. The fabric 18 is carried by the belt 12 over a vacuum dewatering station 20, and then proceeds to a series of drying cans 22.

Evans, in U.S. Pat. No. 3,485,706, describes a process and apparatus for rearranging/entangling fibrous webs by carrying such webs on a woven belt under a series of high pressure, fine, columnar jets of liquid. Apparatus of the general type disclosed by Evans can be used in the process of this invention, although typically the degree of entanglement contemplated by this invention is less than that generally preferred by Evans.

The degree of fiber entanglement contemplated by this invention is preferably that obtained by the use of jet pressures of from about 200 to about 700 psi, and up to about 20 to 25 rows of orifices, with the orifices being spaced such that there are about 30 to 50 per linear inch. The orifices are usually about 0.005 to 0.007 inch in diameter. The web is usually positioned about ½ to 1½ inches below the orifices. With web speeds of from about 8 to about 100 yards per minute, fibrous webs of from about ½ to about 5 ounces per square yard are conveniently processed.

The Examples below illustrate typical conditions. Selection of conditions in specific cases is dependent upon a number of interrelated factors. For instance, heavier webs usually require more energy to entangle, and therefore usually require higher pressure and/or more rows of orifices. Also, the number of rows of orifices required is directly related to the web speeds. Thus, slower web speeds (as illustrated in the Examples) require only a few rows of orifices, while faster speeds require more rows of orifices. It is well within the skill of the art to select specific entangling conditions for specific cases. As a general rule, the pressure is maintained between about 500 and 700 psi, and adjustments are made to web speed and/or number of rows of orifices to control the degree of entangling.

After the fibrous web has been entangled and dried by the drying cans 22, the dried web 23 proceeds to a rotogravure print bonding station 25 where an aqueous resin binder composition is applied to the dried web in an intermittent pattern. The dried web will ordinarily contain less than about 30 weight percent water, based on fiber weight (30 weight percent is about the equilibrium moisture content of a rayon web in an atmosphere having 100% relative humidity). The print bonding station 25 includes an adjustable upper rotatable back-up roll 24 mounted on a rotatable shaft 26, in adjustably controlled pressure contact with a lower rotatable engraved print roll or applicator roll 28 mounted on a rotatable shaft 30. In contact with the applicator roll 28 is a lowermost pick-up roll 32 mounted on a rotatable shaft 34. The pick-up roll 32 is partially immersed in a bath 36 of a resin binder composition 38. The pick-up roll 32 picks up resin binder composition 38 and transfers it to the applicator roll 28, which applies it to the dried fibrous web 23 as it passes through the nip between the applicator roll 28 and the adjustable back-up roll 24. All the rolls are adjustable in order to be able to control the pressure at said nip. A doctor blade 33 is employed to prevent excessive build up of resin binder composition 38 on the applicator roll 28, i.e., to confine the binder composition 38 substantially to the grooves of the engraved pattern on the applicator roll 28 as the roll 28 contacts the web 23. As a result, the binder 38 is applied to the web 23 in an intermittent pattern corresponding to the engraving on the applicator roll 28.

After the web has passed through the print bonding station 25, the printed web 39 is then subjected to elevated temperature, as by passing around a set of drying cans 40, to dry or cure the resin binder, and the web 41 containing the dried or cured binder is then collected, as a conventional wind-up 42.

The resin binder composition can be the conventional aqueous latex compositions, such as acrylic latexes, polyvinyl acetate latexes, ethylene-vinyl acetate latexes, carboxylated styrene-butadiene rubber latexes, or the like.

The invention can use a wide variety of fibers, including rayon, polyester, nylon, polyprolylene, bicomponent fibers, cotton, and the like, including mixtures thereof. Staple fibers are usually used, e.g., fibers having lengths of at least ½ inch and up to about three inches.

The examples below illustrate the invention:

EXAMPLE 1

A mixture of 70 weight percent Avtex SN1913, 1.5 denier, 1⅛ inch staple rayon and 30 weight percent Celanese Fortrel Type 310, 1.5 denier, 1½ inch staple polyester, was processed through an opener/blender and fed to a random air laying unit, which deposited a 780±25% grains per square yard web onto a forming belt woven of 0.0157-inch diameter polyester monofilaments. It is dual layer fabric having two superimposed layers each having 42 warp monofilaments per inch, and 32 shute monofilaments per inch woven through the warp monofilaments in the following repeating pattern: under two, between the two, over two, between the two, etc.

Using an apparatus similar to that shown in FIG. 1, the web was passed under a water weir to wet the fiber, and was then carried at a speed of 30 feet per minute under 4 orifice strips, each of which contained a row of holes, 50 holes per inch, of 0.005 inch diameter. Water was jetted through the holes in the orifice strips at 600 psi and 140° F.

The web was dewatered by passing over a vacuum slot, and then passed over two stacks of steam cans to dry it. The stacks of steam cans were operated at 40 psi and 80 psi steam pressure, respectively.

The dried web was then run through a print station similar to the one shown in the FIG. 1, and the followng binder formulation was printed on one side of the web:

TABLE 1

| Component | Weight |
|---|---|
| Water | 3.0 Pounds |
| Acrylic Resin Latex[1] | 9.0 Pounds |
| Antifoam Agent (Y-30) | 0.03 Pounds |
| Wetting Agent (NS-5199) | 0.21 Pounds |
| 2% Aqueous Hydroxyethylcellulose | 2.75 Pounds |
| Diammonium Phosphate | 1 Gram |
| Ammonia to pH 7–8 | As required |
| Pigment | 0.035 Pounds |

[1]National Starch 4260, 51% solids

The binder formulation had a viscosity of 1200 centipoises at room temperature (about 70° F.), measured by a viscometer.

The printing roll had an engraved pattern of straight continuous 45° diagonal lines spaced 6 lines per inch. Each line was a groove 0.004 inch deep and 0.015 inch wide. The back-up roll was rubber. The back-up roll was pressed against the printing roll by a pressure of 80 psig, i.e., sufficient pressure was used to insure that all of the binder formulation was transferred to the fibrous web. The speed through the printing station was 30 feet per minute. The printed web was then passed over two sets of steam cans set at 40 and 80 psi steam pressure, respectively.

The web was collected, turned over, and print bonded on the other side by the same procedure. Total binder add-on was 5.9 weight percent, dry solids, based on total fabric weight (average of four samples analyzed; range was 5.2 to 6.2 percent). Representative properties of this fabric, and properties of the fabrics of the other examples, are displayed below in Table III.

EXAMPLE 2

By a procedure analogous to that described in Example 1, the same base web was printed on both sides with the same printing roll. The same binder formulation was used, except that only 1.5 pounds of hydroxyethylcellulose solution was employed. The binder formulation viscosity was therefore reduced to 280 centopoises. Total binder add-on was 7 weight percent, dry solids, based on total fabric weight (average of four samples; range 6.6 to 7.6 percent).

EXAMPLE 3

Avtex SN1913, 1.5 denier, 1⅛ inch staple rayon fibers were processed through an opener/blender, and fed to a random air laying unit, which deposited a 790±25% grains per square yard web onto the same forming belt described in Example 1. The web was then lightly entangled by the procedure described in Example 1, except that the line speed was 36 feet per minute and the water in the jets was at 130° F.

The dried web was then printed on both sides by the following formulation:

TABLE II

| Component | Weight |
|---|---|
| Water | 3.0 Pounds |
| NS 4260 Acrylic Latex | 9.0 Pounds |
| Antifoam Agent (Y-30) | 0.03 Pounds |
| Wetting Agent (NS-5199) | 0.21 Pounds |
| Diammonium Phosphate | 1 Gram |
| 2% Aqueous Hydroxyethylcellulose | 2.75 Pounds |
| Pigment | 0.035 Pounds |
| Ammonia to pH 7–8 | As required |

The viscosity of this formulation was 1200 centipoises at room temperature.

The printing was done by the procedure described in Example 1, except that a diamond patterned printing roll was used, and the nip between the printing roll and the rubber back-up roll was gapped by wrapping 0.007 inch thick tape around the edges of the printing roll. The diamond pattern was formed by two intersecting sets of straight continuous 45° diagonal grooves spaced 6 lines per inch. Each groove was 0.005 inch deep and 0.018 inch wide. Total binder add-on was 9.5 weight percent, dry solids, based on total fabric weight (average of four samples; range 8.8 to 10.2 percent).

EXAMPLE 4

Using the same web described in Example 3, a fabric was produced by printing both sides of the web with the binder formulation described in Example 3. The diamond pattern printing roll described in Example 3 was used, but the printing roll and the back-up roll were not gapped. Total binder add-on was 15.3 weight percent, dry solids, based on total fabric weight (average of four samples; range 14.2 to 16.7).

EXAMPLES 5a AND 5b

Additional test fabric samples were prepared in accordance with the procedure described in Example 1, with testing of the samples on two different dates. Total binder add-on was approximately 5 weight percent, dry solids, based on total fabric weight.

Representative physical properties of the nonwoven fabrics of Examples 1–5b are set forth in Table III below.

TABLE III

| Property | Ex. 1 | Ex. 2 | Ex. 3 | Ex. 4 | Ex. 5a | Ex. 5b |
|---|---|---|---|---|---|---|
| Softness[1], grams | 24 | 21 | 40 | 45 | 27 | 23.6 |
| Wet Grab Tensile[2], Pounds | | | | | | |
| MD | 17.4 | 14.8 | 7.3 | 10.1 | 17.0 | 18.0 |
| CD | 12.1 | 12.9 | 6.0 | 7.7 | 13.1 | 14.1 |
| Elongation, % | | | | | | |
| MD | 45 | 40 | 26 | 25 | 38 | 41 |
| CD | 74 | 71 | 66 | — | 67 | 63 |
| Wet Specific Grab Tenacity[3] | | | | | | |
| MD | 1.9 | 1.7 | 0.8 | 0.9 | 1.8 | 2.0 |
| CD | 1.3 | 1.4 | 0.6 | 0.7 | 1.4 | 1.5 |
| Absorbent Capacity, %[4] | 836 | 780 | 740 | 720 | 698 | 802 |
| Absorbent Time[4], Sec. | 2.5 | 2 | 1 | 1.5 | 1.5 | 3.0 |
| Wet Abrasion[5], Cycles | | | | | | |

TABLE III-continued

| | | | | | | |
|---|---|---|---|---|---|---|
| Top Side | 151 | 226 | 241 | 305 | 295 | 190 |
| Bottom Side | 128 | 227 | 405 | 517 | 250 | 195 |
| Launderability[6], Cycles | 400 | 400 | 540+ | 540+ | 616* | 562* 2092** |

*12" × 12" sample
**8" × 8"sample
[1]Standard "Handle-O-Meter" test on a 4-inch square sample using a ⅜-inch slot. Machine direction of fabric is perpendicular to slot.
[2]4 × 6 inch wet sample tested in an Instron tensile tester at a pull rate of 12 inches per minute. One gripper is 1 inch wide and the other is 1½ inches wide.
[3]Wet grab tensile divided by weight in grains per square yard times 100.
[4]Absorbent capacity - A five gram sample of fabric held in a three gram wire basket is immersed in a container of tap water. Absorbent time is the time for the sample to sink. The sample is immersed for 10 more seconds, the basket with the sample is removed and allowed to drip for 10 seconds, and is then weighed. Absorbent capacity is calculated as follows:

$$\frac{\text{wet weight} - \text{dry weight}}{\text{dry weight of fabric}} \times 100$$

[5]Standard abrasion test on a 3 × 9 inch sample, using a 5 pound head weight. "Top side" refers to the side on which the water jets impinge; "bottom side" is adjacent to the forming belt. Test data for Example 5b was generated after the rubber abrader of the test apparatus was replaced.
[6]Wash durability - each cycle in the wash durability test is a complete agitated wash (for 10 minutes in hot water at about 140° F. containing detergent), rinse (in warm water - about 100° F.), and spin cycle in a Maytag home washing machine containing an eight-pound load of laundry. The fabric is considered to fail when it developes a hole anywhere in the fabric. Two samples of each fabric are used, with the sample size being at least 12 × 12 inches (except for Examples 5a and 5b as noted). For at least part of the wash durability testing of the fabrics of Examples 1-5b, an accelerated test was used in order to save time. Instead of 10-minute agitated wash cycles, 2-hour, 4-hour, and 24-hour agitated wash cycles were used. The results reported in Table III are the equivalent in the standard 10-minute wash cycles.

The data in Table III illustrate the unusual combination of strength, softness, and durability of the nonwoven fabrics made in accordance with the invention.

The beneficial combination of excellent strength, softness, and durability (as evidenced by wash durability) is believed to be a consequence of a number of cooperating factors, some of which can be seen in the photomacrographic cross-sections of the fabrics of Examples 1-4, shown in FIGS. 2-5, respectively. First, the softness or drapability, as measured by the Handle-O-Meter, is probably the result of the resin binder being concentrated in relatively limited spaces with an absolute minimum of diffusion or migration. In the preferred mode of operation of the invention, the binder does not extend all the way through from one surface of the fabric to the other. This feature is also believed to contribute to softness or drapability. In the prior art print binding of wet fibrous webs, there is a substantial amount of diffusion of binder both laterally and through the web. The diffused binder adds to stiffness or boardiness with little or no additional contribution to strength.

The wash durability exhibited by the fabrics of this invention is little short of amazing. Several factors appear to cooperate to produce this result. First, the fibers are firmly embedded in the binder areas so that disentangling does not readily occur. Second, some fibers extend in the direction perpendicular to the surfaces of the fabric. Therefore, even though the center of the fabric is binder-free, it is probable that virtually all of the fibers in the fabric are bonded at least twice along their lengths.

Referring now specifically to FIGS. 2-5, cross-sections of the fabrics of Examples 1-4 are shown. The binder is found in discrete areas 50 with very sharp boundaries between these areas and the areas that contain no binder. As can be seen in the photomacrographs, the binder is quite concentrated in the binder areas 50, and there is an absolute minimum of diffusion or migration of binder outside the binder areas 50.

The photomacrographs also clearly show the preferred mode of the invention wherein the binder areas 50 do not extend all the way from one surface of the fabric to the other, thereby leaving binder-free areas 52 in the center of the fabric adjacent to the binder areas 50.

One additional feature of the invention that can be seen in these photomacrographs is the occasional fiber 54 that extends in the direction generally perpendicular to the planes of the surfaces.

In order to minimize migration or diffusion of the binder so that it will be concentrated in the binder areas, and thereby achieve the optimum combination of strength, softness, and durability, the binder formulation preferably has a viscosity of at least about 300 centipoises at 72° F., to about 2000 centipoises. At lower viscosities, e.g., below about 150-200 cps, significant binder migration or diffusion can begin to occur.

The viscosity of the aqueous resin binder compositions can be increased by adding aqueous solutions of thickeners such as hydroxyethylcellulose, acrylic acid polymers, alginates, and the like.

Typical binder solids in the binder formulation is from about 25 to about 45 weight percent.

A wide variety of printing patterns can be employed. In general, the discrete binder areas should be spaced apart a distance less than the average length of the fiber used in the web, and preferably less than about one-half the length of the fiber. At the other end, the binder areas should be spaced far enough apart to maintain the discreteness or separateness of the binder areas. The printing pattern can be in the form of straight lines, wavy lines, dashes, dots, annular circles ("donuts"), ovals, "torpedoes", intersecting lines (diamond pattern), and the like. The fabric can be print bonded on one side only, but for optimum strength and durability is preferably printed on both sides.

The amount of binder add-on has not been found to be narrowly critical. As a general rule, the binder add-on, on a dry binder solids basis, will usually be within the range of from about ¼ to about 25 weight percent, and preferably from about ½ to about 20 weight percent, based on fiber weight.

Rotogravure printing is one preferred mode of carrying out the invention. However, other types of printing can be used. Examples include rotary screen printing, etc.

The novel print bonded nonwoven fabrics of the invention are characterized by the following:

(a) the basic fibrous web is composed of entangled staple-length fibers. The entangling of the fibers is at least sufficient to impart to the web of entangled fibers sufficient integrity to be able to subject the web, when dry and binder-free, to rotogravure printing with aqueous binder compositions with no significant picking of the fibers by the printer. (As was mentioned above, dry unbonded staple fiber webs that are not entangled cannot be rotogravure print bonded without having individual fibers "picked" out of the web by the print roll to such a degree that fouling of the printing operation occurs in a very short time);

(b) The binder is present in the fabric in discrete areas (i.e., in an intermittent pattern) on at least one surface, and preferably both surfaces, of the fabric. The discrete areas are spaced apart a distance less than the average length of the staple fibers in the web, and preferably less than one-half the length of said fibers;

(c) The proportion of binder in the fabric is from about ¼ to about 25 weight percent, and preferably from about ½ to about 20 weight percent, based on weight of fibers;

(d) The binder to fiber weight ratio in the binder areas per se is usually relatively high, e.g., of the order of about 1:1, binder:fiber, and higher; and (e) Preferably, the binder areas extend through the fabric a distance less than one-half the thickness of the fabric, and more preferably, there is a binder-free region between the discrete binder areas extending from each surface.

FIGS. 6–9 are plan view photomacrographs of the fabrics of Examples 1–4, respectively. The photographs were taken at exactly 10.0× to provide a convenient means for measuring the widths of the binder areas, for the purpose of determining the "spread" or increase in width over the recessed grooves in the rotogravure printing roll. Table IV, below, displays the measured widths of the binder areas (in the 10× photographs), the actual widths, the widths of the grooves in the printing rolls, and the increase in widths.

TABLE IV

| Example | Binder Area Width, mm | | Groove | Increase | |
|---|---|---|---|---|---|
| | Measured | Actual | Width, mm | mm | % |
| 1 | 5 | 0.5 | 0.38 | 0.12 | 31 |
| 2 | 6 | 0.6 | 0.38 | 0.22 | 57 |
| 3 | 5 | 0.5 | 0.45 | 0.05 | 10 |
| 4 | 6 | 0.6 | 0.45 | 0.15 | 32 |

As these data illustrate, there is very little spread or area increase of the binder when it is applied to the fibrous web.

What is claimed is:

1. A method of producing a strong, durable nonwoven fabric comprising: (a) forming a layer of overlapping intersecting polyester or polyolefin or both fibers; (b) supporting said layer on an apertured support member; (c) jetting pressurized fluid through rows of orifices to form essentially columnar jets of fluid and directing said jets of fluid against the surface of the fibrous support layer opposite said support member without impeding or diffusing said jets, to rearrange the fibers into a regular repeating pattern of lightly entangled fiber regions, and; (d) applying an effective amount of an adhesive bonding material to said rearranged layer.

2. A method of producing a nonwoven fabric according to claim 1 wherein the apertured support member has a predetermined topography.

3. A method of producing a nonwoven fabric according to claim 1 wherein the jets of fluid are streams of water.

4. A method of producing a nonwoven fabric according to claim 1 including drying the fabric at an elevated temperature to cure the adhesive bonding material.

5. A method of producing a nonwoven fabric according to claim 1 wherein the apertured support member has a predetermined topography, the jets of fluid are streams of water, and the fabric is dried at an elevated temperature to cure the adhesive bonding material.

6. A strong, durable nonwoven fabric comprising a layer of polyester or polyolefin or both fibers, said fibers being disposed in a regular repeating pattern of lightly entangled fiber regions of higher area density than the average area density of the layer, and interconnecting fibers extending between the lightly entangled fiber regions and being randomly entangled with each other in said regions, and an effective amount of an adhesive binder, said fabric formed by the method of claim 1 and exhibiting a strength greater than the combined strength attributable to the amount of binder and degree of entanglement used to form said fabric.

7. The fabric of claim 6 wherein the fibers are polyester.

8. The fabric of claim 6 wherein the fibers are polypropylene.

9. The nonwoven fabric of claims 6, wherein adhesive binder material is uniformly distributed through the layer.

10. The nonwoven fabric of claims 6, wherein the adhesive binder material is distributed in an intermittent pattern of spaced binder areas.

11. Process which comprises:

(a) supporting a layer of staple-length fibrous starting material whose individual fibers are in mechanical engagement with one another but which are capable of movement under applied liquid forces, on a liquid pervious support member adapted to move in a predetermined direction;

(b) moving the supported layer in said predetermined direction through a zone within which streams of high pressure, fine, essentially columnar jets of water are projected directly onto said layer to produce a web of entangled fibers;

(c) drying the web of entangled fibers;

(d) applying, by printing, an effective amount of an aqueous resin binder composition to the dried web in an intermittent pattern; and (e) drying said aqueous resin binder composition after it has been applied to said web.

12. Process of claim 11 wherein said binder composition is applied to said dried web so as to produce discrete binder areas that extend into said web a distance less than the thickness of said web.

13. Process of claim 11 wherein said aqueous binder composition is applied to both surfaces of said dried web.

14. Process of claim 13 wherein said binder composition is applied to each surface of said dried web so as to produce discrete binder areas that extend into said web a distance such that a region free of binder is maintained inside said web between the discrete binder areas on each surface.

15. Process of claim 14 wherein said fibrous starting material is rayon or a mixture of rayon and polyester.

16. Process of claim 15 wherein said aqueous resin binder composition has a viscosity of from about 300 to about 2000 centipoises at 72° F.

17. Process of claim 14 wherein said aqueous resin binder composition has a viscosity of at least about 150 centipoises at 72° F.

18. Process of claim 13 wherein said fibrous starting material is rayon or a mixture of rayon and polyester.

19. Process of claim 18 wherein said aqueous resin binder composition has a viscosity of from about 300 to about 2000 centipoises at 72° F.

20. Process of claim 13 wherein said aqueous resin binder composition has a viscosity of at least about 150 centipoises at 72° F.

21. The bonded fibrous web produced by the process of claim 11.

* * * * *